US006172619B1

(12) United States Patent
Lumbis et al.

(10) Patent No.: US 6,172,619 B1
(45) **Date of Patent: *Jan. 9, 2001**

(54) AUTOMATIC TRAIN SERIALIZATION WITH CAR ORIENTATION

(75) Inventors: Anthony W. Lumbis, Watertown; Dale R. Stevens, Adams Center, both of NY (US)

(73) Assignee: New York Air Brake Corporation, Watertown, NY (US)

( * ) Notice: Under 35 U.S.C. 154(b), the term of this patent shall be extended for 0 days.

This patent is subject to a terminal disclaimer.

(21) Appl. No.: 09/255,339

(22) Filed: Feb. 23, 1999

Related U.S. Application Data

(63) Continuation-in-part of application No. 08/837,113, filed on Apr. 14, 1997, now Pat. No. 5,966,084, which is a continuation-in-part of application No. 08/713,347, filed on Sep. 13, 1996, now abandoned.

(51) Int. Cl.[7] ..... G08B 1/01; B61L 3/00

(52) U.S. Cl. ..... 340/933; 340/825.05; 340/825.06; 340/531; 246/1 C; 246/6; 246/122 R; 246/167 R; 104/88.03; 701/19

(58) Field of Search ..... 340/933, 531, 340/825.05, 825.13, 825.06; 246/1 C, 2 E, 2 R, 3–6, 122 R, 124, 166.1, 167 R; 104/88.02, 88.03, 88.04, 88.05, 88.06, 297; 701/19

(56) References Cited

U.S. PATENT DOCUMENTS

| | | | |
|---|---|---|---|
| 3,721,820 | 3/1973 | Caulier et al. | 246/247 |
| 4,689,602 | 8/1987 | Morihara et al. | 340/458 |
| 4,702,291 | 10/1987 | Engle | 105/35 |
| 4,825,189 | 4/1989 | Honma et al. | 246/166.1 |
| 5,168,273 | 12/1992 | Solomon | 340/825.54 |
| 5,651,517 | 7/1997 | Stevens et al. | 246/2 R |
| 5,777,547 | 7/1998 | Waldrop | 340/438 |
| 5,815,823 | 9/1998 | Engle | 701/19 |
| 5,966,084 | * 10/1999 | Lumbis et al. | 340/933 |

FOREIGN PATENT DOCUMENTS

| | | |
|---|---|---|
| 2100770 | 7/1972 | (DE) . |
| 808 761 A1 | 11/1997 | (EP) . |

OTHER PUBLICATIONS

A breakthrough in trainline communications?, Railway Age, Aug. 1995.

* cited by examiner

*Primary Examiner*—Donnie L. Crosland
(74) *Attorney, Agent, or Firm*—Barnes & Thornburg

(57) ABSTRACT

A method of serialization including establishing a parameter along a length of the train between a node on one of the cars and one end of the train. The presence or absence of the parameter at each node is determined and the parameter is removed. The sequence is repeated for each node on the train. Finally, serialization of the cars is determined as a function of the number of either determined presences or absences of the parameter for each node. The parameter can be established by providing at the individual node, one at a time, an electric load across an electric line running through the length of the train and measuring an electrical property, either current or voltage, at each node. The same process is used to determine the orientation of a car. The operability of each node is determined by counting the presence and then the absence of a parameter along the whole train.

26 Claims, 7 Drawing Sheets

AUTOMATIC TRAIN SERIALIZATION WITH CAR ORIENTATION

CROSS-REFERENCE

This application is a continuation-in-part of continued prosecution application filed Sep. 3, 1998 of Ser. No. 08/837,113 filed Apr. 14, 1997 Now U.S. Pat. No. 5,996,084, which is a continuation-in-part of U.S. patent application Ser. No. 08/713,347 filed Sep. 13, 1996 now abandoned.

BACKGROUND AND SUMMARY OF THE INVENTION

The present invention relates generally to trainline communications and more specifically, to the serialization of cars in a train.

With the addition of electropneumatically operated train brakes to railway freight cars comes a need to be able to automatically determine the order of the individual cars and locomotive in the train. In an EP brake system utilizing a neuron chip or other "intelligent circuitry", a wealth of information is available about the status of each car and locomotive in the train. But unless the location of the car or locomotive in the train is known, the information is of little value. It has been suggested that each car or locomotive report in at power-up. While this provides information on which cars and locomotive are in the train consist, it does not provide their location in the consist. Also, in some trains, the direction the car or locomotive is facing or orientation in the train is required. Typical examples are rotary dump cars and remotely located locomotives.

Present systems address this issue by requiring that the order of the cars in the train be manually entered into a data file in the locomotive controller. While this does provide the information necessary to properly locate each car in the train, it is very time consuming when dealing with long trains, and must be manually updated every time the train make-up changes (i.e. when cars are dropped off or picked up). The present invention eliminates the need for manually entering this data by providing the information necessary for the controller to automatically determine the location of each car and EP control module or node in the train.

Historically, there has only been a communication link between one or more of the locomotives in a train with more than one locomotive needed. Current EP systems require a communication link between all cars and locomotives in a train or consist. The Association of American Railroads has selected as a communication architecture for EP systems, LonWorks designed by Echelon. Each car will include a Neuron chip as a communication node in the current design. A beacon is provided in the locomotive and the last car or end of train device to provide controls and transmission from both ends of the train.

The serialization of locomotives in a consist is well known as described in U.S. Pat. No. 4,702,291 to Engle. As each locomotive is connected, it logs in an appropriate sequence. If cars are connected in a unit train as contemplated by the Engle patent, the relationship of the cars are well known at forming the consist and do not change. In most of the freight traffic, the cars in the consist are continuously changed as well as the locomotives or number of locomotives. Thus, serialization must be performed. more than once.

The present invention is an automatic method of serialization by establishing a parameter along a length of the train between a node on one of the cars and one end of the train.

The presence or absence of the parameter at each node is determined and the parameter is removed. The sequence is repeated for each node on the train. Finally, serialization of the cars and orientation of at least one car are determined as a function of the number of either the determined presences or absences of the parameter for each node.

The parameter can be established by providing, at the individual node one at a time, an electric load across an electric line running through the length of the train. Measuring an electrical property, either current or voltage, at each node determines the presence of the parameter. Each node counts the number of presences or absences of the parameter determined at its node and transmits the count with a node identifier on the network for serialization. The line is powered at a voltage substantially lower than the voltage at which the line is powered during normal train operations.

To determine the orientation of a car within the train in a first embodiment, a local node may be provided with a primary and secondary node adjacent a respective end of the car. In the sequence, the parameter is established for the car having a primary and secondary node using at least the primary node. Determination of the presence or absence of the parameter uses both primary and secondary nodes. The use of the primary node alone to establish the parameter is sufficient to determine the orientation of the car. Alternatively, both the primary and secondary node may be sequentially activated to establish a parameter.

Another method of determining orientation according to a second embodiment is establishing a parameter at one node and detecting the presence or absence of the parameter at that node. If the parameter is present, the car has one orientation and if absent, the car has the opposite orientation.

Prior to establishing a parameter along a length of the train, a count of the number of the cars in the train and their identification of each car is obtained. After the sequence of establishing the number of presences or absences of the parameter for each car is completed, the count of the number of the cars in the train is compared with the number of cars which transmit a count. Preferably, determining the presence or absence of the parameter includes determining the presence or absence of the parameter at each node except for the node which has established the parameter.

Testing operability of the nodes includes establishing a parameter along the length of the train and determine the presence or absence of the parameter at each node. The parameter is then removed and the presence or absence of the parameter at each node is again determined. Operability of the node is determined as a function of either the presences or absences of the parameter which was determined for each node.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
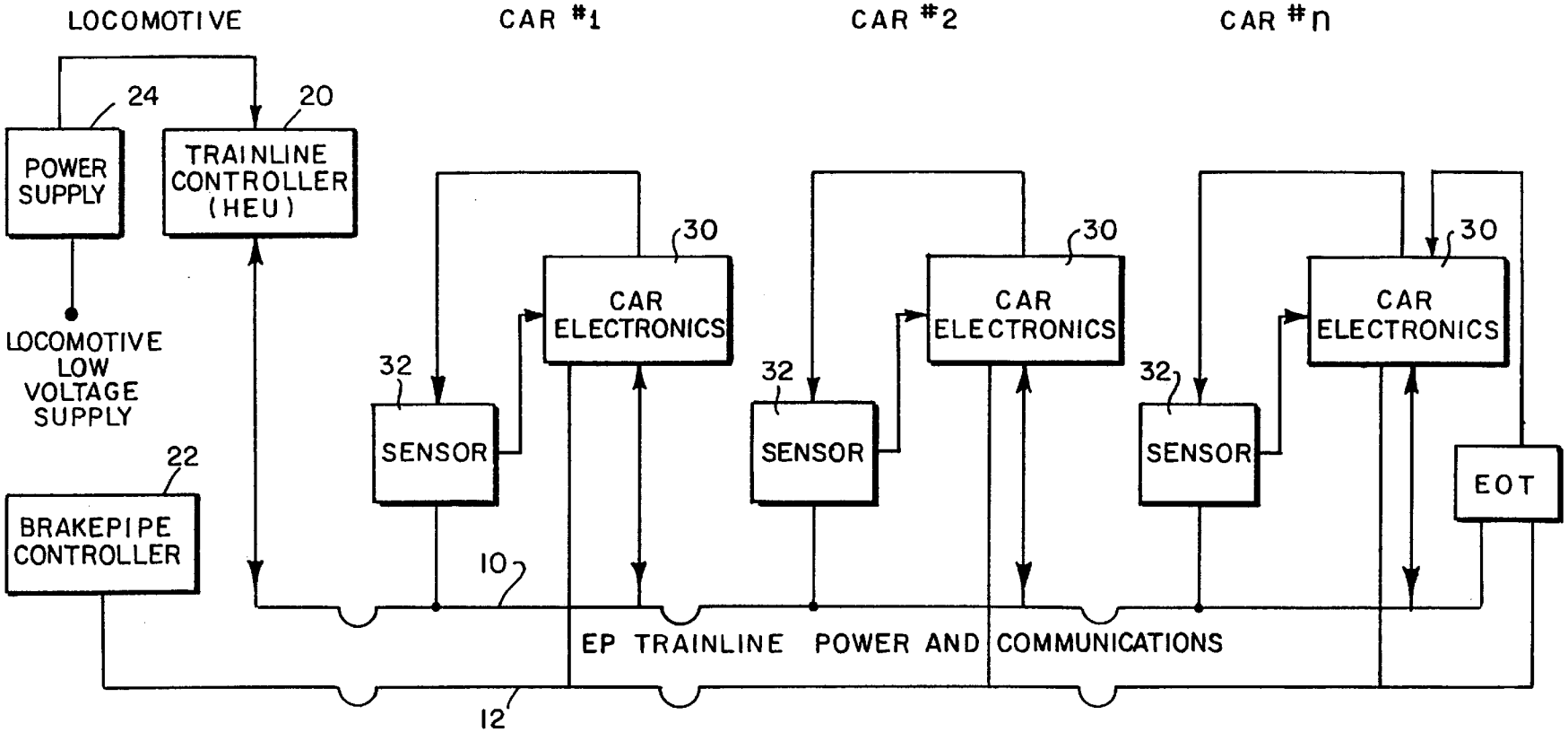
FIG. 1 is a block diagram of a train incorporating electropneumatic brakes and a communication system incorporating the principles of the present invention.

A train consisting of one or more locomotives and a plurality of cars is shown in FIG. 1. An electropneumatic trainline 10 transmits power and communication to the individual nodes on the cars. A brake pipe 12 provides pneumatic pressure to each of the cars to charge the reservoirs thereon and can fluctuate pressure to apply and release the brakes pneumatically. The locomotive includes a trainline controller 20 (HEU) which provides the power and the communication and control signals over the EP trainline 10. A brake pipe controller 22 controls the pressure in the brake pipe 12. A power supply 24 receives power from the locomotive low voltage supply and provides the required power for the trainline controller 20 and the EP trainline 10.

Each of the cars include car electronics 30 which are capable of operating the electropneumatic brakes as well as providing the necessary communications. The trainline controller 20 and the car electronics 30 are preferably LonWorks nodes in a communication network although other systems and regimens may be used. Car electronics 30 will also provide the necessary monitoring and control functions at the individual cars. With respect to the present serialization method, a sensor 32 is connected to the car electronics 30 to sense the current or voltage of the trainline 10 at each node or car. Preferably, the sensor 32 is a current sensor and may be a Hall effect sensor or any other magnetic field sensor which provides a signal responsive to the current in the trainline 10. Alternatively, the sensor 32 may be a voltage sensor. As will be discussed, the car electronics 30 measures a parameter at its node or car and transmits the results along the trainline 10 to the trainline controller 20.

The brake pipe 12 is also connected to the car electronics 30 of each car as well as the air brake equipment (not shown). The car electronics 30 monitors the brake pipe 12 for diagnostic and brake control and controls the car's brake equipment. The trainline's power and communication is either over common power lines or over power and separate communication lines. The individual communication nodes are also powered from a common power line even though they may include local storage battery sources.

An end of car device EOT is shown as connected to the car electronics of the last or car #n. The EOT may be a stand alone node on the network having its own car electronics 30. In either case, the EOT has a load resistor which can be connected to the trainline 10 to test all the node sensors as described below.

Figure 2:
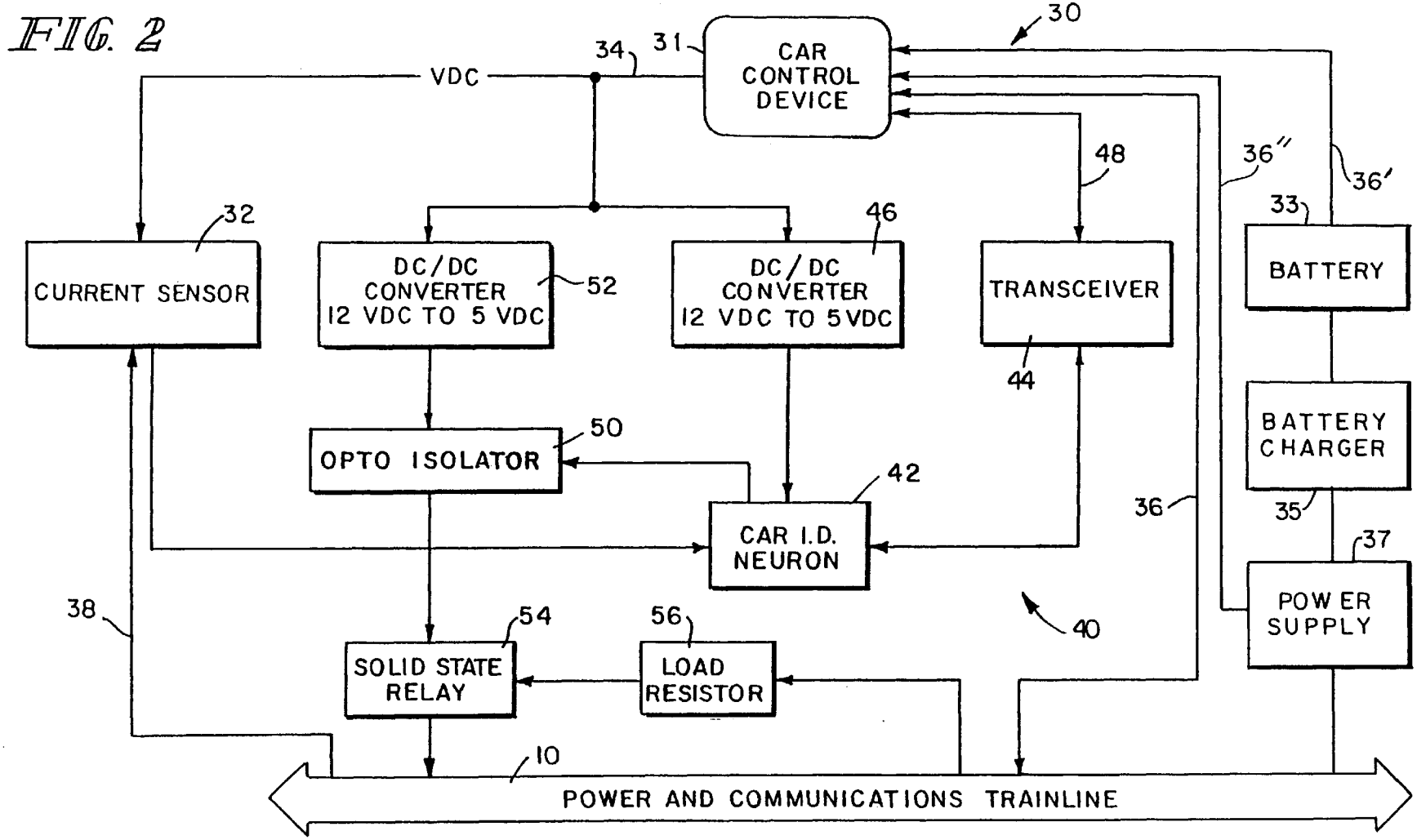
FIG. 2 is a block diagram of the electronics in the individual cars of the train incorporating the principles of the present invention.

A more detailed diagram of the car electronics 30 is illustrated in FIG. 2. The local communication node includes a car control device 31. The car control device 31 includes a Neuron chip, appropriate voltage regulators, memory and a transceiver to power itself and communication with the trainline controller and other cars as a node in the communication network. A LonWorks network is well-known and therefore need not to be described herein. The car control device 31 is capable of operating electropneumatic brakes as well as providing the necessary communication. The car control device 31 can also provide the necessary monitoring control functions of other operations at the individual cars.

Cable 36 connects the car control device electronics 31 to the power and communication trainline 10 so as to power the car control device and to provide the necessary communication using the transceiver of the car control device. Preferably, the car electronics includes a battery 33 connected to line 36' and charged from the trainline 10 by battery charger 35 and power supply 37. The battery 33 provides, for example, 12 volts DC via line 36' and the power supply 37 provides a 24 volts DC via line 36". The car control device 31 controls the operation of power supply 37 and provides a DC voltage of approximately 12 volts on line 34. The current sensor 32, which is preferably a digital output current sensor, is powered by line 34 and is connected to the trainline 10 by wire 38. The current sensor 32 in combination with load resistor 56, which is selectively connected to the power and communication trainline 10 by relay 54, is used for automatic train serialization.

Each of the cars includes a storage device which stores identification data which includes at least the serial number, braking ratio, light weight, and gross rail weight of the car. The storage device is permanently mounted to the car and need not be changed. If there is change in the information, preferably the storage device is programmable. Alternatively, the information may be stored in the car control device 31 if it has sufficient memory.

Preferably, a storage device is a communication node 40 of the communication network. The subsidiary node includes a Neuron controller 42 having the car identification data therein and communicates with the car control device 31 by transceiver 44. A DC converter 46 provides, for example, 5 volts power from line 34 to the Neuron 42 and the transceiver 44. The Neuron 42 also receives an output from the digital output current sensor 32 and stores the current information.

The Neuron 42 may control an opto-isolator 50 and DC converter 52, which receives its power from line 34, to operate the solid state relay 54 to connect load resistor 56 to the trainline 10. This is used in the current sensing routine for the current sensor 32. The load resistor is part of current sensing and serialization. Alternatively, the car control device 31 may control the opto-isolator 50 and solid state relay 54.

Figure 3:
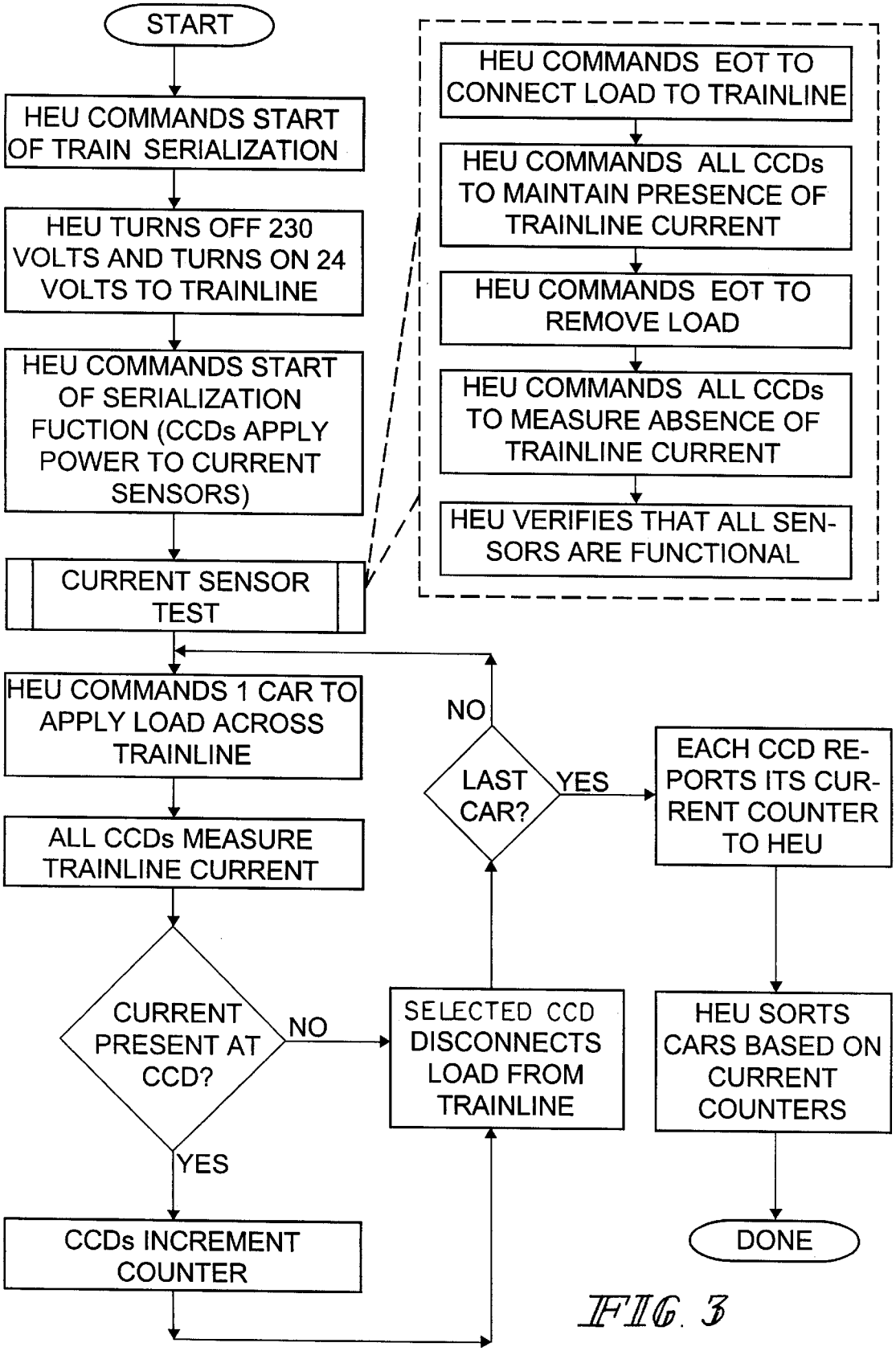
FIG. 3 is a flow chart of the method of serialization according to the principles of the present invention.

The method of train serialization, using the apparatus of FIGS. 1 and 2 for example, is illustrated in the flow chart of FIG. 3. In order to perform serialization, the head end unit HEU 20 must know the train make up or configuration. After the train is made up, i.e. all cars connected and powered up, the HEU 20 powers up all car control devices 31 using a normal high, for example 230 volts DC, trainline power. The HEU then takes a roll call or polls the network to determine the number and type of cars in the train and stores the information. This information can be compared with a manual manifest of the cars. Once the manifest has been verified, the HEU powers down the trainline and then powers up the trainline with a low voltage, for example, 24 volts DC. Once the trainline is powered with 24 volts DC, the HEU requests that each of the car control devices apply a 12 volt DC from their battery 33 to the current sensor 32 and associated serialization electronics.

Before the serialization process begins, the current sensors of each car electronics 30 are tested. The head-end unit HEU commands the end of train device EOT to apply its load resistor 56 to the trainline 10. Preferably, this applies a one amp load to the trainline. The head-end device HEU then commands all cars to measure and record the presence of a current. All operable sensors should detect and record a current present. Next, the head-end unit HEU commands the end of train device EOT to remove the load resistor 56. With no load, the head-end unit commands all cars again to measure the presence of current. All operable sensors should measure no current.

The results of these two measurements are then transmitted to the head-end unit. All cars that have reported a count of one are operable current sensors. Cars that report zero or two indicate faulty current sensors. If each cycle of the two cycle test is reported individually, the total count as well as the order of the count will determine operable/faulty sensors. The knowledge of operable and inoperable sensors is important to the serialization process.

Once the verification of current sensors has taken place, serialization begins. The serialization process will individually and sequentially ask each car to activate its load resistor and request the other cars to determine if trainline current is present. Those cars between the car control device which has applied its load and the head-end unit will detect current. Those cars between the car control device which has the activated load and the end of train will not detect a current. Alternatively, the power supply may be at the end of train device EOT and the presence of current will be from the applied load to the end of the train. At the end of the sequence, the count in each car is reported to the head-end unit which then can perform serialization.

As illustrated in FIG. 3, the head-end unit commands one car to apply its load 56 across the train and all car control devices 31 measure the trainline current. If the current sensor 32 senses current, it increments a counter at its car control device. If no current is sensed, it does not increment its counter. The selected car control device then disconnects its load resistor 56 from the line. The head-end unit then determines whether this is the last car in the verified manifest. If it is not, it repeats the process until all cars have been polled and connected their load to the trainline. When the last car has been completed, each car control device reports its present count to the head-end unit.

The head-end unit then sorts the cars based on the present counter value. An example of the counts for five nodes as they individually apply a load is illustrated in Table 1 as follows:

TABLE 1

FIG. 2-not counting self/presences

| Neuron ID-Load | Nodes Sensing Current | | | | |
|---|---|---|---|---|---|
| Applied | ID1 | ID2 | ID3 | ID4 | ID5 |
| ID3 | 1 | 1 | 0 | 0 | 0 |
| ID1 | 0 | 0 | 0 | 0 | 0 |
| ID2 | 1 | 0 | 0 | 0 | 0 |
| ID5 | 1 | 1 | 1 | 1 | 0 |
| ID4 | 1 | 1 | 1 | 0 | 0 |
| Total | 4 | 3 | 2 | 1 | 0 |

Preferably, the head-end unit commands all cars except the car with the load across the line to measure the presence of the current. By not counting itself, the orientation of the car and consequently the position of the sensor with respect to the load is eliminated from the count. Thus, the last car will have a count of zero and the car closest to the head-end unit would have the highest count. If the absences of the current is counted instead of the presences of the current, the last car would have the highest count and the closest car the lowest count.

A validity check of the serialization can be performed by checking the number of cars that are reported against the number of cars having operable sensors. Only a car with a good current sensor and a count of zero can be the last car, counting current presences.

After completion of serialization, the head-end unit switches off the 24 volt DC power from the trainline. It also commands each car control device 31 to terminate the serialization function by turning off the power to their current sensors 32. The head-end unit then applies its normal operating 230 volts DC to the trainline. Alternatively, the serialization may be carried out at the 230 volt DC on the trainline with appropriate protection of the electronic elements.

Figure 4:
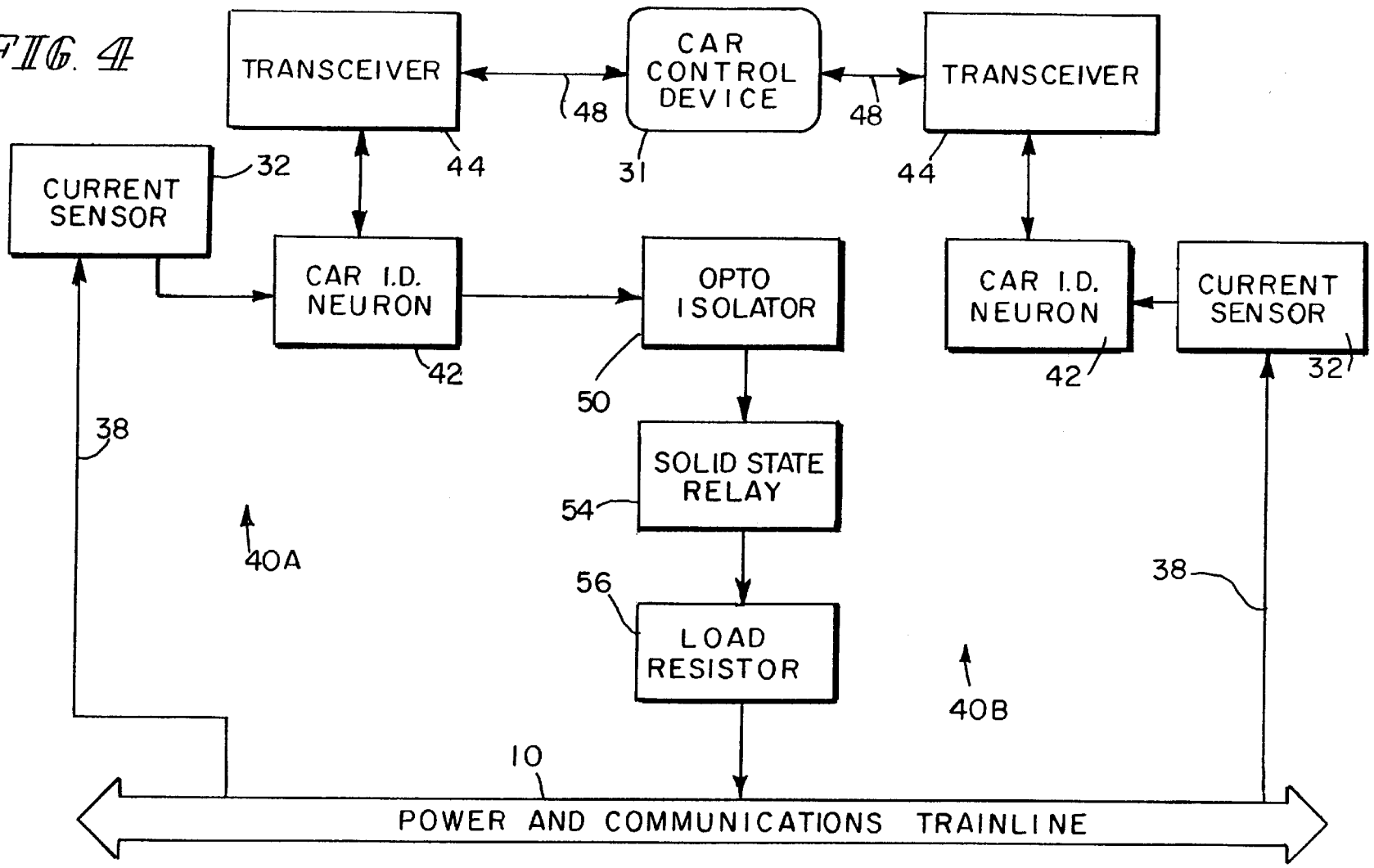
FIG. 4 is another block diagram of another embodiment of electronics in the individual cars of the train incorporating the principles of the present invention.

For certain cars, it is important to determine which direction the car is facing or orientation in the train. These may be, for example, rotary dump cars or remotely located locomotives. The method of the present invention may determine the orientation of the car and the locomotive using the embodiment of FIGS. 4 and 5. In FIG. 4, the car whose orientation is required would include a primary communication node 40A and a secondary communication node 40B connected to the car control device 31. It should be noted that the power source connections in FIGS. 4 and 5 have been deleted for sake of clarity. The primary node 40A includes as a current sensor 32, the car ID Neuron 42, the transceiver 44, the opto-isolator 50, the solid state relay 54 and load resistor 56. The secondary node would include only the car ID Neuron 42, the transceiver 44 and the current sensor 32.

By locating the load resistor 56 at the primary communication node, the orientation of the cars can be determined. While only the primary node would be used in the sequence of applying the load for the car, both of the current sensors and the car ID Neuron would count the presence of the variable and provide it to the car control device 31. The count of both of the primary and secondary nodes would be transmitted for use in determining the orientation of car as well as the position of the car in the train. The car ID Neurons 40 of the primary and secondary circuits would include the same car ID with an additional bit or letter indicating a particular end of the car or whether it is a primary or secondary circuit.

Table 2 illustrates the presence of current at the primary and secondary nodes on five of the cars using the circuit of FIG. 4 and not including the primary node its self in the count when it applies the load. Alternatively, the absences may be counted.

TABLE 2

FIG. 4-not counting self/presences

| Neuron ID- | Nodes Sensing Current | | | | | | | | | |
|---|---|---|---|---|---|---|---|---|---|---|
| Load | ID1 | | ID2 | | ID3 | | ID4 | | ID5 | |
| Applied | A | B | B | A | A | B | B | A | A | B |
| ID3 | 1 | 1 | 1 | 1 | 0 | 0 | 0 | 0 | 0 | 0 |
| ID1 | 0 | 0 | 0 | 0 | 0 | 0 | 0 | 0 | 0 | 0 |
| ID2 | 1 | 1 | 1 | 0 | 0 | 0 | 0 | 0 | 0 | 0 |

TABLE 2-continued

FIG. 4-not counting self/presences

| Neuron ID- | Nodes Sensing Current | | | | | | | | | |
|---|---|---|---|---|---|---|---|---|---|---|
| Load | ID1 | | ID2 | | ID3 | | ID4 | | ID5 | |
| Applied | A | B | B | A | A | B | B | A | A | B |
| ID5 | 1 | 1 | 1 | 1 | 1 | 1 | 1 | 1 | 0 | 0 |
| ID4 | 1 | 1 | 1 | 1 | 1 | 1 | 1 | 0 | 0 | 0 |
| Total | 4 | 4 | 4 | 3 | 2 | 2 | 2 | 1 | 0 | 0 |

It is noted that cars of ID2 and ID4 are facing in a different direction than cars of ID1, ID3 and ID5. If the primary or secondary counts are the same, the primary node is forward or closest to the head end unit. If the counts are different, the higher count for a car will determine which orientation of the car. This is evident from Table 2. Also, the sequence of the count of different count cars indicates orientation.

By locating the single load resistor 56 per car between the current sensors 32 of the primary and secondary communication nodes, the orientation of the cars can also be determined.

Table 2A illustrates the presence of current at the primary and secondary nodes on five of the cars using the circuit of FIG. 4 and including the primary node its self in the count when it applies the load. Alternatively, the absences may be counted.

TABLE 2A

FIG. 4-counting self/presences

| Neuron ID- | Nodes Sensing Current | | | | | | | | | |
|---|---|---|---|---|---|---|---|---|---|---|
| Load | ID1 | | ID2 | | ID3 | | ID4 | | ID5 | |
| Applied | A | B | B | A | A | B | B | A | A | B |
| ID3 | 1 | 1 | 1 | 1 | 1 | 0 | 0 | 0 | 0 | 0 |
| ID1 | 1 | 0 | 0 | 0 | 0 | 0 | 0 | 0 | 0 | 0 |
| ID2 | 1 | 1 | 1 | 0 | 0 | 0 | 0 | 0 | 0 | 0 |
| ID5 | 1 | 1 | 1 | 1 | 1 | 1 | 1 | 1 | 1 | 0 |
| ID4 | 1 | 1 | 1 | 1 | 1 | 1 | 1 | 0 | 0 | 0 |
| Total | 5 | 4 | 4 | 3 | 3 | 2 | 2 | 1 | 1 | 0 |

Determining which of the primary or secondary counts are higher for a car will determine the orientation of the car. This is evident from Table 2A. Again, the sequence of the count provides the orientation as well as the sequence of the cars.

Figure 5:
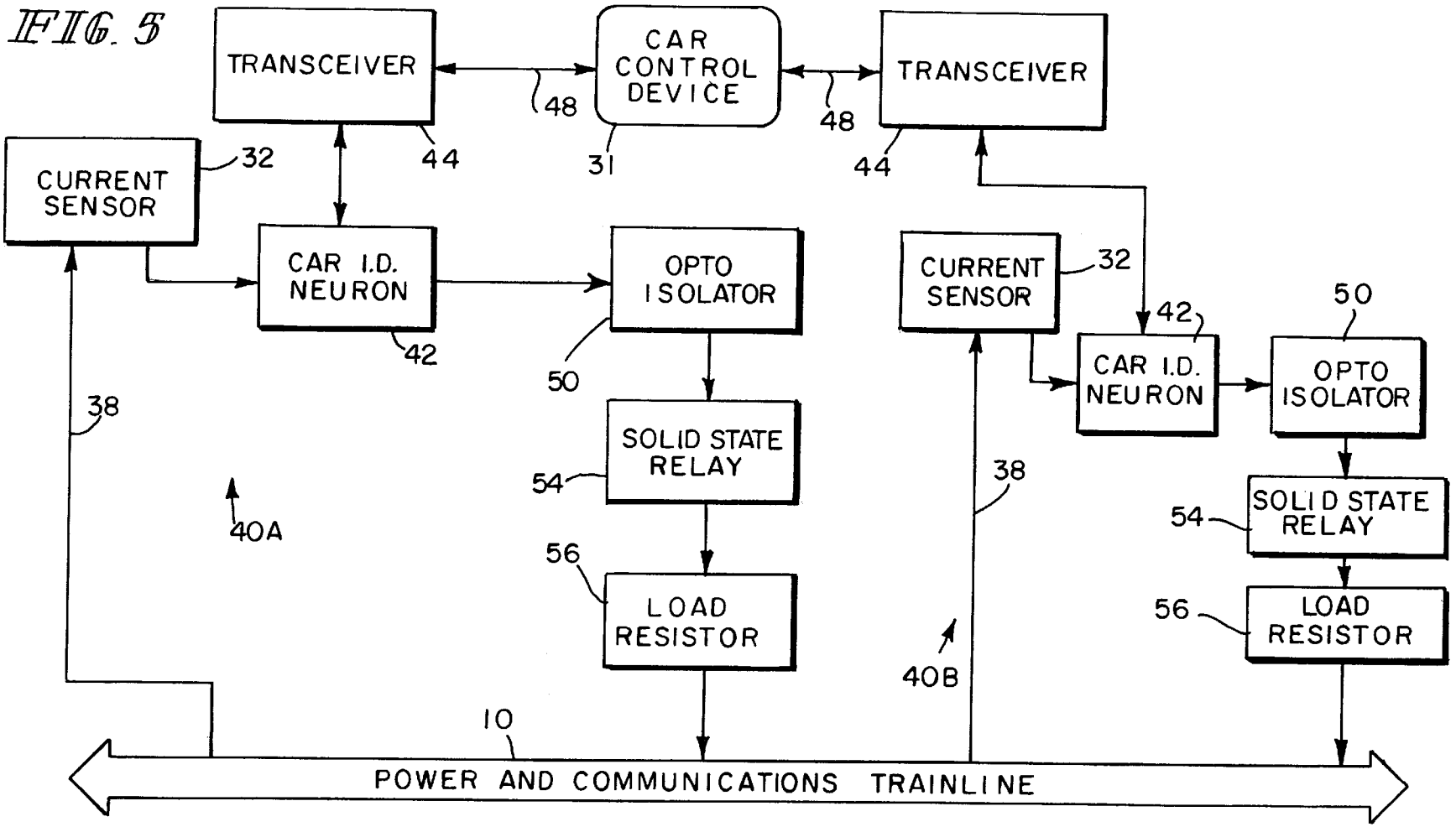
FIG. 5 is a block diagram of a third embodiment of electronics in the individual cars of the train incorporating the principles of the present invention.

Another embodiment of the present invention which has the capability of determining the orientation of the car is illustrated in FIG. 5. Each of the primary and secondary nodes 40A and 40B are identical, each including, not only a current sensor 32, ID Neuron 42 and transceiver 44, but also each includes an opto-isolator 50, solid state relay 54 and a load resistor 56. In this instance, each of the primary and secondary nodes are sequentially actuated and treated as separated nodes. The resulting counts during the sequence as well as the totals are illustrated in Table 3.

TABLE 3

FIG. 5-not counting self/presences

| Neuron ID- | | Nodes Sensing Current | | | | | | | | | |
|---|---|---|---|---|---|---|---|---|---|---|---|
| Load | | ID1 | | ID2 | | ID3 | | ID4 | | ID5 | |
| Applied | | A | B | B | A | A | B | B | A | A | B |
| ID3 | A | 1 | 1 | 1 | 1 | 0 | 0 | 0 | 0 | 0 | 0 |
| | B | | | | | | | | | | |
| ID1 | A | 0 | 0 | 0 | 0 | 0 | 0 | 0 | 0 | 0 | 0 |
| | B | 1 | 0 | 0 | 0 | 0 | 0 | 0 | 0 | 0 | 0 |
| ID2 | A | 1 | 1 | 1 | 0 | 0 | 0 | 0 | 0 | 0 | 0 |
| | B | 1 | 1 | 0 | 0 | 0 | 0 | 0 | 0 | 0 | 0 |
| ID5 | A | 1 | 1 | 1 | 1 | 1 | 1 | 1 | 1 | 0 | 0 |
| | B | 1 | 1 | 1 | 1 | 1 | 1 | 1 | 1 | 1 | 0 |
| ID4 | A | 1 | 1 | 1 | 1 | 1 | 1 | 1 | 0 | 0 | 0 |
| | B | 1 | 1 | 1 | 1 | 1 | 1 | 0 | 0 | 0 | 0 |
| Total | | 9 | 8 | 7 | 6 | 5 | 4 | 3 | 2 | 1 | 0 |

Table 3 includes not counting the node in which the load is applied. This results in numbers 0–9. If the node which applied the load is included in the count, each of the numbers would be increased by 1 and therefore the count would be 1–10. If absences are counted, the count would be 1–10 in the reverse order. In the example of Table 3, the cars of ID2 and ID4 are facing in a different direction than the cars of ID1, ID3 and ID5.

Although the example has shown all car nodes having two nodes, the train could and generally would have only some of the cars requiring orientation information. Thus, either all of the cars could include dual nodes or only those for which orientation information is required.

A review of Table 2A of the self counting current sensor and looking only at the A current sensor indicates that the cars 1, 3 and 5, which have the current sensor at the side A closer to the head end than the load, have a count of one when they apply the load. The cars that have the opposite orientation, which are cars 2 and 4, which have the load closer to the head end then the current sensor at the A end, have a zero count when they apply the load. Thus, using a single current sensor 32 and a single load 56, as illustrated in FIG. 2, can be used to locally determine the orientation of the car when that node applies the load. The result of such a count for the orientation for the previously discussed example, is illustrated in Table 4. An A is provided in the Table where determination has been made that the A end is closer to the head end than the B end.

TABLE 4

FIG. 2-counting self/presences

| Neuron ID- | Nodes Sensing Current | | | | | | | | | |
|---|---|---|---|---|---|---|---|---|---|---|
| Load | ID1 | | ID2 | | ID3 | | ID4 | | ID5 | |
| Applied | A | B | B | A | A | B | B | A | A | B |
| ID3 | 1 | | 1 | | 1A | | 0 | | 0 | |
| ID1 | 1A | | 0 | | 0 | | 0 | | 0 | |
| ID2 | 1 | | 0 | | 0 | | 0 | | 0 | |
| ID5 | 1 | | 1 | | 1 | | 1 | | 1A | |
| ID4 | 1 | | 1 | | 1 | | 0 | | 0 | |
| Total | 5A | | 3 | | 3A | | 1 | | 1A | |

Figure 6:
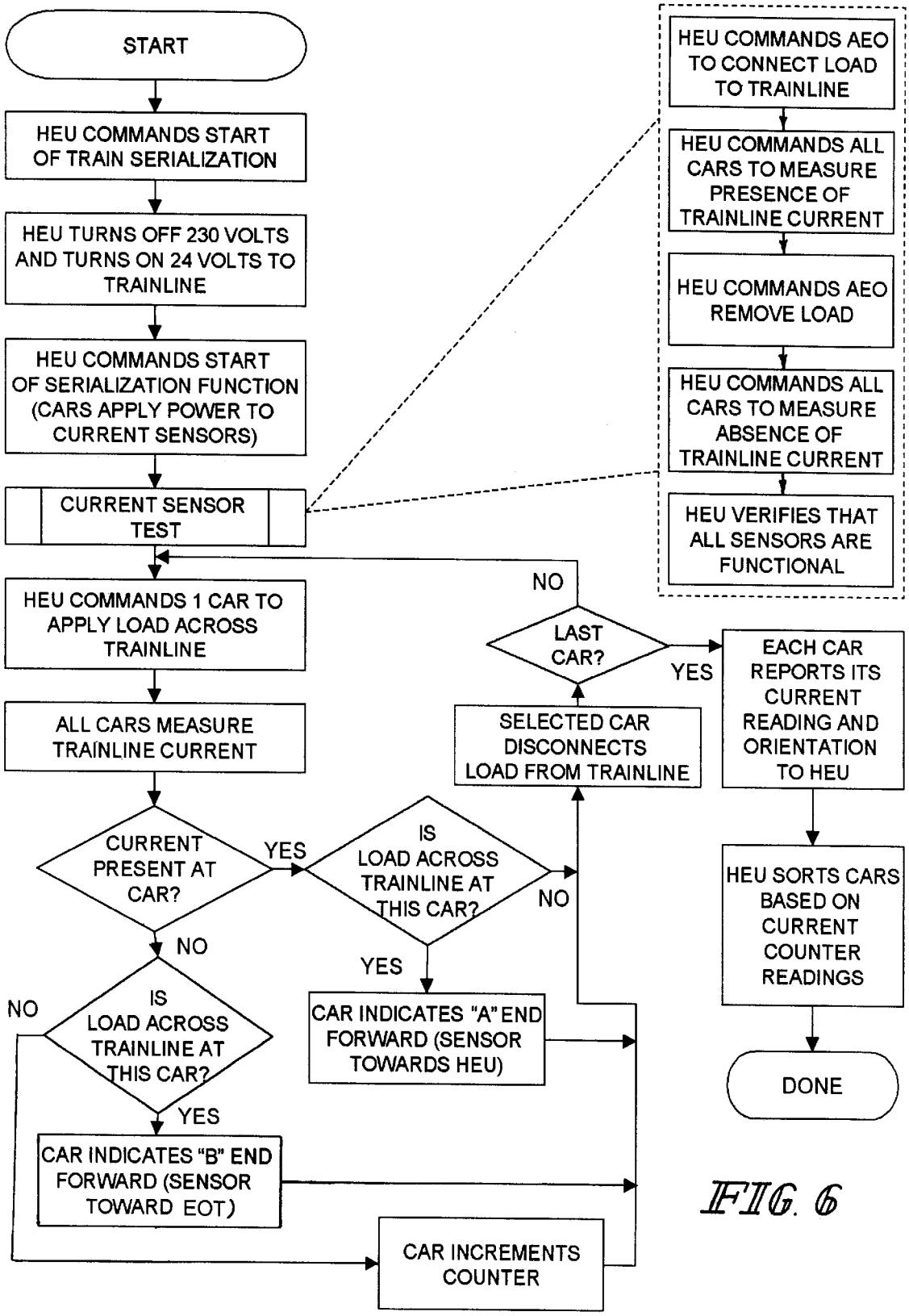
FIG. 6 is a flow chart of a method for serialization in combination with orientation according to the principles of the present invention.

A modification of the flow chart of FIG. 3 to include the orientation using the single sensor and count of absences is illustrated in FIG. 6. The modification is after the decision making block of whether current is present at the car. If current is present, then there is a determination of whether the load is across the train at this car. If it is not, the sequence is continued to the next car. The remainder of the flow chart is the same as that in FIG. 3 except the reporting of car orientation. If current is present at the car and the load is across the train at this car, then the car identifies the A end or the sensor is towards the head end unit.

If current is not present at the car, then the determination is made of whether the load is across the trainline at this car. If it is not, then the car increments the counter and continues the process as in FIG. 3. If the current at the car is not present and the load is across this car, then the car indicates that the end B is forward, namely, the sensors toward the end of train. The car selected is disconnected from load.

As a variation of FIG. 3, the car reports its current counter reading and its orientation to the head end unit.

Table 5 shows the results of counting the absences.

TABLE 5

FIG. 2-counting self/absences

| Neuron ID- | Nodes Sensing Current | | | | | | | | | |
|---|---|---|---|---|---|---|---|---|---|---|
| Load | ID1 | | ID2 | | ID3 | | ID4 | | ID5 | |
| Applied | A | B | B | A | A | B | B | A | A | B |
| ID3 | 0 | | 0 | | 0A | | 1 | | 1 | |
| ID1 | 0A | | 1 | | 1 | | 1 | | 1 | |
| ID2 | 0 | | 1 | | 1 | | 1 | | 1 | |
| ID5 | 0 | | 0 | | 0 | | 0 | | 0A | |
| ID4 | 0 | | 0 | | 0 | | 1 | | 1 | |
| Total | 0A | | 2 | | 2A | | 4 | | 4A | |

Figure 7:
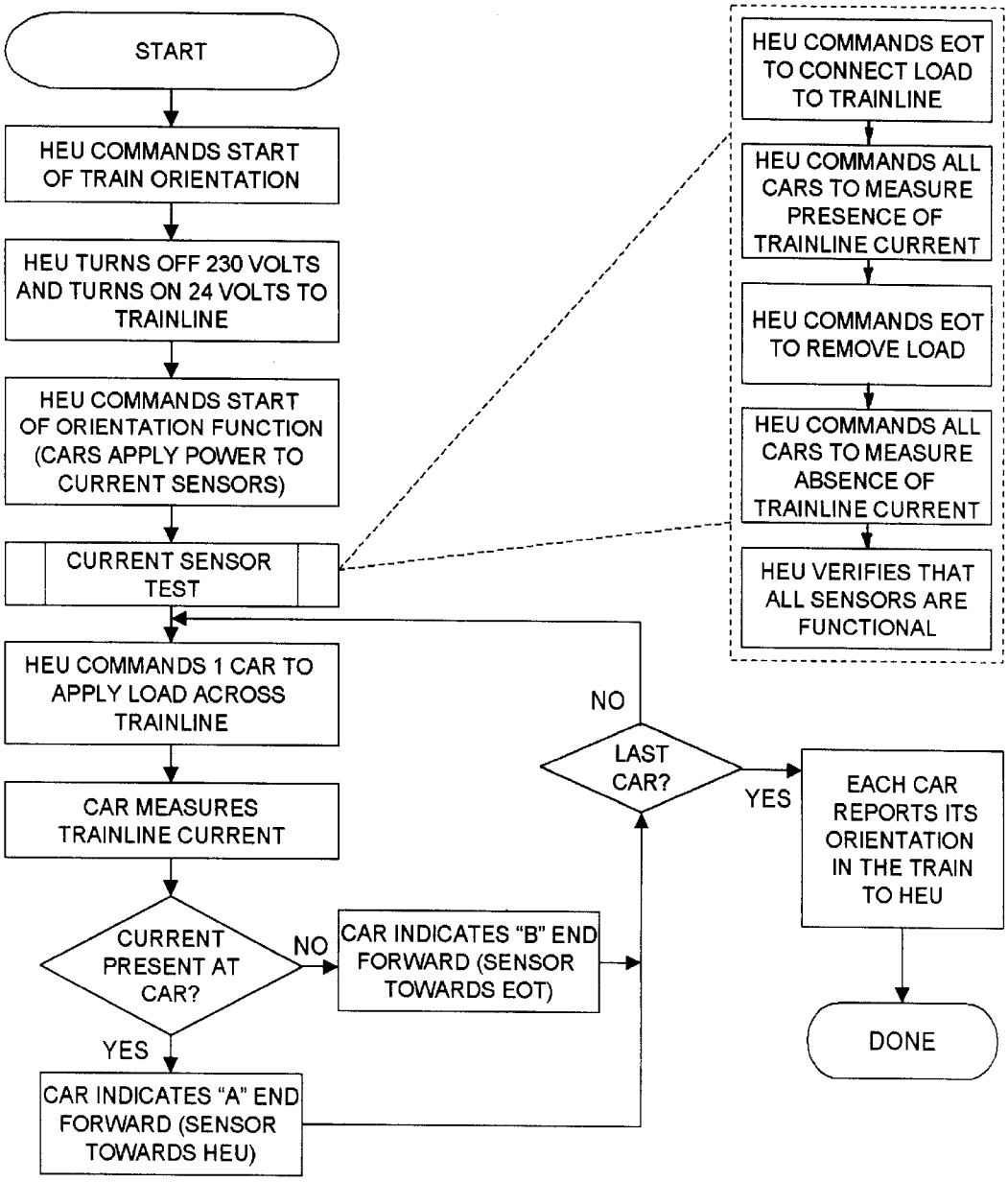
FIG. 7 is a flow chart of a method of orientation according to the principles of the present invention.

As a subsection of the process of FIG. 6, the orientation alone can be determined using the procedure of FIG. 7. The head end unit, HEU, commands the start of the car orientation. This includes the head end unit turning off the 230 volt source and turning on the 24 volts to the trainline. The head end unit then commands start of the orientation function. This includes cars applying power to the current sensors, and the current sensors are tested. This is as in the previous processes of FIGS. 3 and 6. The head end unit then commands one car to apply the load across the trainline. This car measures the trainline current and determines whether current is present at that car. If current is present, then it indicates that the car A end is forward, namely, the sensors towards the head end unit. If current is not present at the car, then the car indicates that the B end is forward with the current sensor towards the end of train. The head end unit continues this cycle until all of the cars have been commanded to apply a load across the trainline and determine their orientation. When it is determined that it is the last car, then each car reports their orientation in the train to the head end. This ends the car orientation process.

Although FIGS. 2 and 5 show the load being applied at the head end side of the trainline 10 with respect to the current sensors, their position on the trainline may be reversed. This would not affect the ability of the present system or method to be performed. It would only change the counts that appear on the tables, where the load applying node counts itself.

The present serialization method has been described with respect to using a load resistor 56 and current sensors. The current is a parameter which can be measured over a specific length of train and sequentially selected. As previously discussed, a voltage sensor may be used in lieu of a current sensor. Also, the brake pipe 12 may also be used to establish a parameter between one of the cars and an end of the train. This will require the ability to isolate the brake pipe from one car and one end of the train from the brake pipe from the car to the other end of the train and the ability to create difference in pressure in each portion. The car electronics 30 would also require the ability to sense the conditions in the brake pipe. If such equipment and capabilities are available on the car, the present process can be performed by sequentially commanding modification of the brake pipe pressure at each of the cars and monitoring a response at the other cars.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. In a train including at least one locomotive and a plurality of cars, each car being serially connected to an adjacent car and having a local communication node, and a controller in a network with said communication nodes, a method of serializing said cars comprising:

a) establishing a parameter along a length of said train between one node and one end of said train;

b) determining presence or absence of said parameter at each node;

c) removing said parameter;

d) repeating steps a, b and c for each node on said train; and e) serializing said cars and determining orientation of at least one car as a function of the number of either the determined presences or absences of said parameter for each node.

2. The method according to claim 1, wherein:

establishing said parameter includes providing at said one node an electrical load across an electrical line running the length of the train; and determining presence or absence of said parameter includes measuring an electrical property of said line at each node.

3. The method according to claim 2, wherein measuring an electrical property includes measuring the current of said line at each node.

4. The method according to claim 2, wherein measuring an electrical property includes measuring the voltage of said line at each node.

5. The method according to claim 1, wherein each node counts the number of absences of the parameter determined at its node and transmits the count with a node identifier on said network for serialization.

6. The method according to claim 1, wherein each node counts the number of presences of the parameter determined at its node and transmits the count with a node identifier on said network for serialization.

7. The method according to claim 6, including:

prior to the first step a, obtaining a count of the number cars in said train and an identification of each car in said train; and after the last step c, comparing the count of the number of cars in the train with the number of nodes which transmit a count.

8. The method according to claim 1, wherein determining presence or absence of said parameter includes determining presence or absence of said parameter at each node except said one node.

9. The method according to claim 1, wherein said local communication node of at least one car includes a primary and a secondary node adjacent a respective end of said at least one car; and for said at least one car, establishing said parameter for said at least one car using at least said primary node and determining presence or absence of said parameter using both said primary and secondary nodes.

10. The method according to claim 9, including determining the orientation of said at least one car in said train as a function of the number of either the determined presences or absences of said parameter for said primary and secondary nodes.

11. The method according to claim 9, wherein establishing said parameter for said at least one car using said primary node only and determining the presence or absence of said parameter using both said primary and secondary nodes.

12. The method according to claim 9, wherein establishing said parameter for said at least one car using said primary and secondary nodes sequentially and determining presence or absence of said parameter using both said primary and secondary nodes.

13. The method according to claim 1 including determining from the determination of presence or absence of said parameter at the one node from which the parameter is established, the orientation of the car for the one node.

14. In a train including at least one locomotive and a plurality of cars, each car being serially connected to an adjacent car and having local communication node, and a controller in said locomotive in a network with said communication nodes, wherein:

said controller sequentially requests the local node of each car, one at a time, to establish a parameter along a length of said train between the node and one end of said train;

each node includes means for determining and counting the number of either presences or absences of said parameter at the node during the sequence of requests and means for transmitting the count on said network; and means on the network for serialization of said cars and orientation of at least one car as a function of said transmitted counts.

15. The train according to claim 14, wherein:

each node connects an electrical load at each node across an electrical line running the length of the train to establish said parameter; and each node includes means for measuring an electrical property of said line at each node.

16. The train according to claim 15 wherein each node includes means for measuring the current of said line at each node.

17. The train according to claim 15 wherein each node includes means for measuring the voltage of said line at each node.

18. The train according to claim 14, wherein:

prior to the sequencing, the controller obtains a count of the number cars in said train and an identification of each car in said train; and after the sequencing, the controller compares the count of the number of cars in the train with the number of nodes which transmit a count.

19. The train according to claim 14, wherein each node counts the number of presences or absences of said parameter determined during the sequence except when the node establishes said parameter.

20. The train according to claim 14, wherein each node transmits its count with a node identifier.

21. The train according to claim 14, wherein said local communication node of at least one car includes a primary and a secondary node adjacent a respective end of said at least one car; and for said at least one car, said parameter for said at least one car is established by at least said primary node and presence of said parameter is determined by both said primary and secondary nodes.

22. The train according to claim 21, including means on said network for determining the orientation of said at least one car in said train as a function of the number of determined presences or absences of said parameter for said primary and secondary nodes.

23. The train according to claim 21, wherein said parameter for said at least one car is established by said primary node only and presence or absence of said parameter is determined by both said primary and secondary nodes.

24. The train according to claim 21, wherein said parameter for said at least one car is established by said primary and secondary nodes sequentially and presence or absence of said parameter is determined by both said primary and secondary nodes.

25. The train according to claim 14, wherein the one node from which the parameter is established determines orientation of the car for the one node from the determination of presence or absence of said parameter.

26. In a train including at least one locomotive and a plurality of cars, each car being serially connected to an adjacent car and having a local communication node, and a controller in a network with said communication nodes, a method of serializing said cars comprising:

a) establishing a parameter along a length of said train between one node and one end of said train;

b) determining presence or absence of said parameter at each node;

c) determining the orientation of the car for the one node from the determination of presence or absence of said parameter at the one node from which the parameter is established;

d) removing said parameter;

e) repeating at least steps a, b and d for each node on said train; and f) serializing said cars and determining orientation of at least one car as a function of the number of either the determined presences or absences of said parameter for each node.

* * * * *